US005327616A

United States Patent [19]

Lautenschläger

[11] Patent Number: 5,327,616

[45] Date of Patent: Jul. 12, 1994

[54] CABINET HINGE

[75] Inventor: Horst Lautenschläger, Reinheim, Fed. Rep. of Germany

[73] Assignee: Mepla-Werke Lautenschlager GmbH & Co. KG, Reinheim, Fed. Rep. of Germany

[21] Appl. No.: 22,064

[22] Filed: Feb. 24, 1993

[51] Int. Cl.[5] ..... E05D 5/00

[52] U.S. Cl. ..... 16/382; 16/385; 16/388

[58] Field of Search ..... 16/382, 384, 388, 389, 16/252, 237

[56] References Cited

U.S. PATENT DOCUMENTS

| | | | |
|---|---|---|---|
| 888,049 | 5/1908 | Squires et al. | 16/252 |
| 4,139,924 | 2/1979 | Vitt | 16/384 |
| 4,554,706 | 11/1985 | Rock et al. | 16/237 |
| 4,604,769 | 8/1986 | Röck et al. | 16/382 |

FOREIGN PATENT DOCUMENTS

| | | | |
|---|---|---|---|
| 45051 | 10/1888 | Fed. Rep. of Germany | 16/252 |

*Primary Examiner*—Lowell A. Larson
*Assistant Examiner*—Donald M. Gurley

[57] ABSTRACT

The present invention relates to a cabinet hinge (10) for hanging a door on a cabinet whose front opening is narrowed by a frame reaching inward at right angles from the side walls, which is at least partially overlapped by the inside of the closed door. The hinge (10) has an arm (28) of sheet metal which has a mounting plate (32) which can be placed on the free edge (16) of a stile (14) of the frame and releasably fastened thereon, whose width corresponds essentially to the width of the edge (16) of the stile (14), and which bears the arm (28) coupled by a link mechanism to the hinge member (22) attached to the door. On the front and back margins of the mounting plate (32) there is created at least one tab (36; 38) bent substantially at right angles against the outer and inner faces of the stile (14). The inner tab or tabs (38) are provided with a pointed or knife-edged projection (40) extending toward the inner face of the stile (14).

8 Claims, 2 Drawing Sheets

CABINET HINGE

Figure 2:
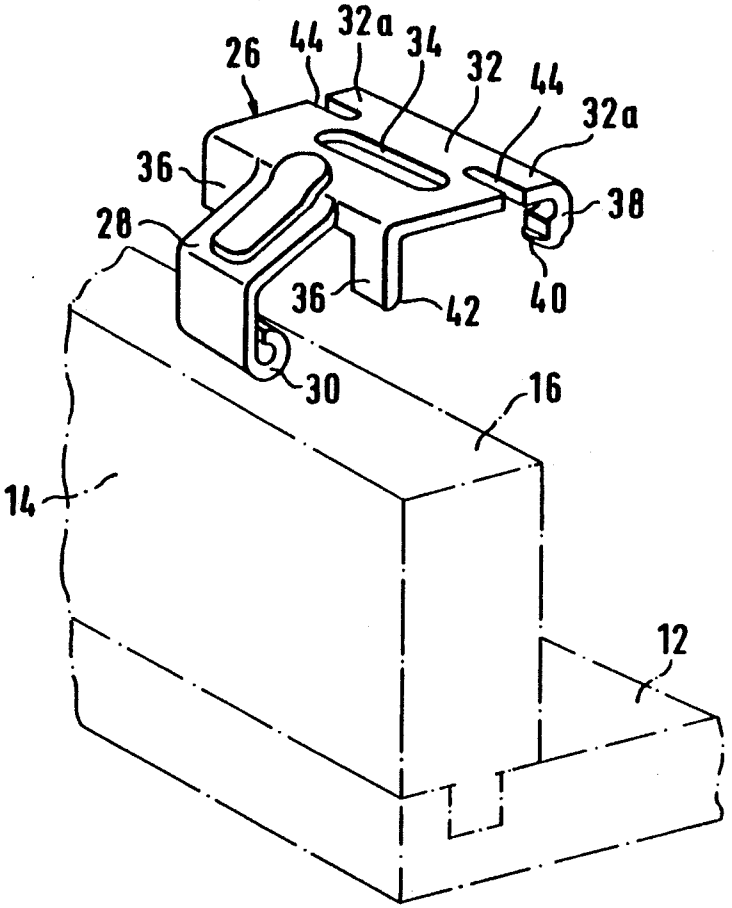

The invention relates to a hinge for hanging a door on a cabinet whose front opening is narrowed by a frame, formed of stiles and rails reaching inward at right angles from the side walls, which is at least partially overlapped by the inside of the door when the door is closed.

Hinges which are intended for such frame-front cabinets are, as a rule, held at their cabinet end by a mounting plate which can be screwed onto the edge of the stile of the frame, while the portion of the mounting plate that is of a width approximately equal to the thickness of the stile can be part of a mounting plate on which the hinge's supporting arm, which forms the actual carcase-related hinge member, can be adjustably fastened, or else the mounting plate can be an integral part of the hinge arm. To be able to adjust the level of the door after it is hung, the openings provided in the mounting plate for the screws are, as a rule, in the form of slots, so that, when the screws are loosened, the door can be shifted upward or downward within the length of the slots. The mounting plate is then fixed in the new set position by tightening the screws.

The precise location of the mounting plate with respect to the horizontal adjustment of the door on the cabinet is as a rule assured by providing on the front margin of the mounting plate tabs bent at right angles, which are brought into contact with the front face of the stile, thus determining the horizontal position of the mounting plate, and hence of the hinge arm, with respect to the cabinet. The hanging of doors on cabinets is performed, at least in large series production, with hinges pre-mounted on the doors by lowering the doors with the hinge arms in the open position onto the cabinet and onto the edge of the stiles, and then the mounting screws are driven through the slots in the mounting plates and into the stiles. For this purpose two persons are needed, as a rule, one of whom holds the door and aligns it relative to the cabinet, while the second person drives the screw in at least to the point where the door is initially held on the cabinet.

It is the object of the invention to create a hinge which will permit the door to be mounted on the stile of the cabinet by one person without running the risk of dropping the door and possibly damaging the face frame of the cabinet. However, it must still be possible to adjust the level of the door with the mounting screws loosened.

Setting out from a hinge of the kind described above, this object is achieved according to the invention by the fact that, on the front and back margins of the mounting plate at least one tab is bent substantially at right angles against the inner and outer face of the stile, and the inner tab is provided with a pointed or knife-edged projection extending toward the inner face of the stile. For the preliminary installation of the mounting plate on the stile, the procedure can then be to place the mounting plate at an angle onto the stile such that the inner tabs reach behind the inner face of the stile, while the front tabs come to rest in the marginal area of the front face of the stile. Then pressure is exerted on the hinge arm, via the door standing with the hinge open and via the door-related part of the hinge, bringing the front tab over the front arris of the stile and bringing the mounting plate against the edge of the stile. At the same time the pointed or sharpened projections on the inside tabs penetrate into the inside surface of the stile, thereby providing a positive holding of the mounting plate on the stile even if no screw has been driven through the slot into the stile. I.e., the door is thus set in place without the need for a second person to drive the screws. The screws are not driven until the next operation, i.e., it can be done by the same person who mounted the door or, in the case of production lines, it can be done at the next station.

To enable the tab provided at the outer margin of the mounting plate to ride over the front arris of the stile without damaging the stile, it is recommended that at least the tabs of one of the margins of the mounting plate be made springy, so that the space between the inner and outer tabs can vary within a given range without permanent deformation.

This springiness can be achieved by selecting the material of the hinge arm and of the tabs and their dimensions such that the tabs themselves are springy.

Alternatively, the tabs can also be created on a section of the mounting plate which itself is springy on the rest of the mounting plate. This can be accomplished, for example, by providing slits in the mounting plate.

The projection provided on the inside tabs of the hinge arm is, in an advantageous development of the invention, provided on the free end of the tabs and is sharpened to a knife edge, and has an arcuate profile. When the vertical adjustment of the door is made, this knife edge of the projection, penetrating into the back of the stile during preliminary assembly, will permit movement only in the direction of adjustment without escaping from the stile.

The screw holes in the mounting plates of the hinge arms holding a door on the cabinet are then made, in a known manner, in the form of elongated slots running lengthwise of the stiles, through which the mounting screws are driven into the stiles.

The bent tabs provided on the outer margin of the mounting plate are best provided with a rounded cross section at their free end, so as to permit the tabs to slip over the front arris of the edge of the stile during preliminary assembly, without damaging the said arris.

Figure 1:
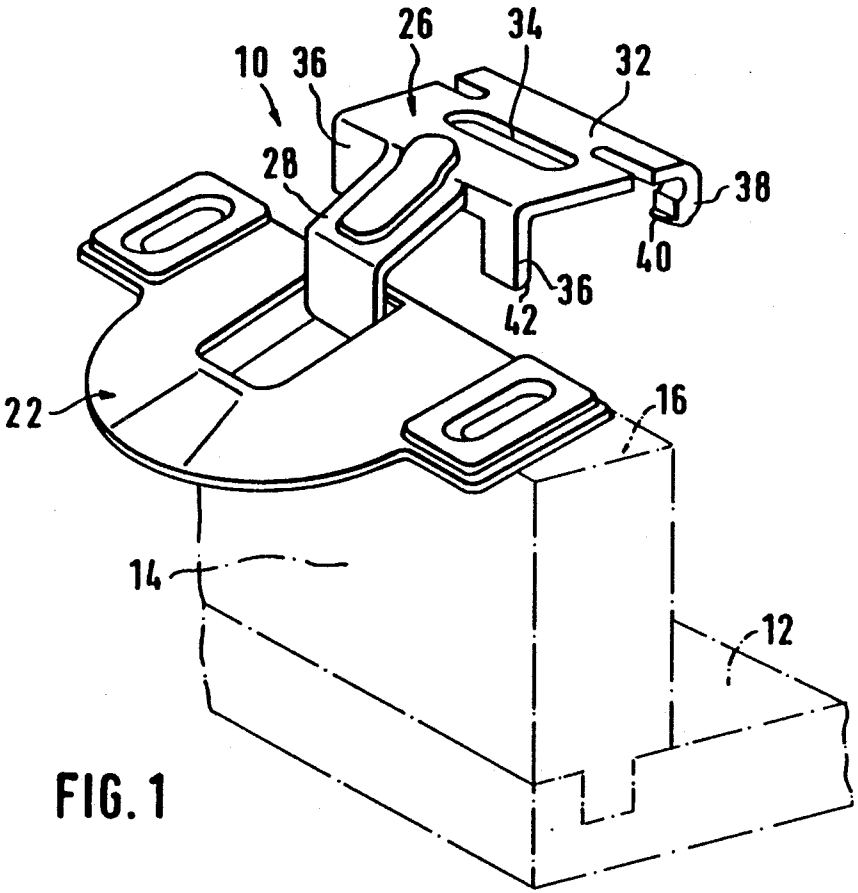

The invention is explained in the following description of an embodiment, in conjunction with the drawing, wherein FIG. 1 is a perspective view of a hinge made in the manner of the invention, FIG. 2 represents a hinge arm in the area of the mounting plate, which is a modification of the hinge arm provided on the hinge represented in FIG. 1, and FIGS. 3*a*, 3*b* and 3*c* are diagrammatic side views of different steps in hanging a door provided with a hinge according to the invention on the hinge-bearing stile of a cabinet.

The hinge shown in FIG. 1 and designated as a whole by 10 serves for hanging a door, not shown, on a cabinet whose front, which is to be closed with the door, is narrowed by an inwardly reaching frame formed of stiles and rails. In the drawing, a section of the stile 14 extending inward from a side wall 12 of a cabinet is indicated in broken lines; the hinge is to be fastened on the edge 16 of the stile.

The hinge 10, configured in this case as a single joint hinge, has a door-related part 22 in the form of a cup which can be mounted flush in a recess 18 (FIGS. 3*a* to 3*c*) in the back of the door 20, and a carcase-related part 26 pivoting on a hinge pin 24 provided inside of the cup.

The carcase-related hinge part 26, made in a known manner by stamping from sheet metal, has a hinge arm 28 on whose end inside of the cup 22 a pivot eye 30 is rolled which holds the hinge pin 24. A substantially flat mounting plate 32 is made integral with the other end of the hinge arm 28, and its width corresponds approximately to the width of the edge 16 of the stile 14, and it has an opening in the form of a slot 34 running parallel to the hinge pivot axis formed by the longitudinal central axis of the hinge pin 24, through which a screw 37 (FIG. 3*c*) can be driven into the edge 16 of the stile 14.

On the front and back margin of the mounting plate 32 two pairs of tabs 36 and 38 are created, each pair spaced apart lengthwise of the stile and bent substantially at right angles against the inner and outer sides of the stile 14, the tabs nearer the cabinet interior having a curving, e.g. arcuate, knife-edge projection 40 pointing toward the inside face of the stile 14. In plan, the projections 40 thus have the approximate shape of a segment of a circle.

The tabs 36 are rounded arcuately in the area of their free end on the side associated with the exterior flat side of stile 14.

Since the width of the mounting plate 32 is equal to the width of the edge 16 of the stile 14, the distance between the tabs 36 and 38 corresponds to the thickness of the stile, i.e., when the mounting flange 32 is in the properly fastened position on the edge 16, the tabs 36 and 38 lie against the front and back sides of the stile 14 and hold the hinge 10, even if the screw 36 is not tightened, against horizontal displacement, i.e., toward the interior of the cabinet or away from the interior of the cabinet. On the other hand, they do permit displacement of the mounting plate 32 and thus of hinge 10 for the purpose of an adjustment in the level of the door 20 mounted by means of the hinge, within the length allowed by the slot 34 when the screw 37 is loosened. The projections 40 on the back tabs 38 cut into the back of the stiles 14 but do not interfere with adjustment lengthwise of the frame, since the arcuately rounded cutting edge offers but little resistance to such displacement.

To be able to preinstall the hinges in the manner to be described hereinbelow in connection with FIGS. 3*a* to 3*c*, the tabs 38 with the projections 40 are deformable springs on the mounting plate 32, and this is brought about by using for the manufacture of the carcase-related hinge part 26 a sheet metal which can be hardened by heat treatment, that is, one which after production by stamping is provided with the necessary springing property at the tabs 38 and possibly also 36. The resistance which the tabs 38 offer to resilient deformation is established by the choice of the dimensions of the tabs and of the arcuate transition such that, upon installation, the tabs 38 and 36 can be sprung apart, although the force necessary for that purpose is so great that the projections 40 in every case dig into the inside surface of the stile 14.

If in the case of the chosen dimensions of the tabs 38 too great a force is needed to flex them, their spring force can be reduced simply by providing the tabs 38 on a portion of the mounting plate 32 which flexes resiliently with respect to the rest of the mounting plate 32. In FIG. 2 such a configuration is shown in a carcase-related hinge part which otherwise is the same as the carcase-related hinge part in FIG. 1. The inside tabs 38 are provided on portions 32*a* of the mounting plate 32 which in turn are made resiliently flexible with respect to the actual mounting plate by slots 44 running from the transverse edges.

Figure 3C:
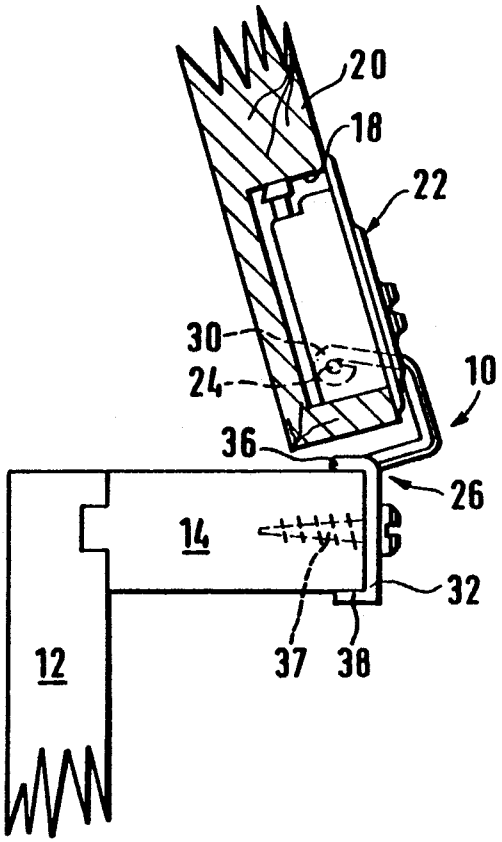
Figure 3B:
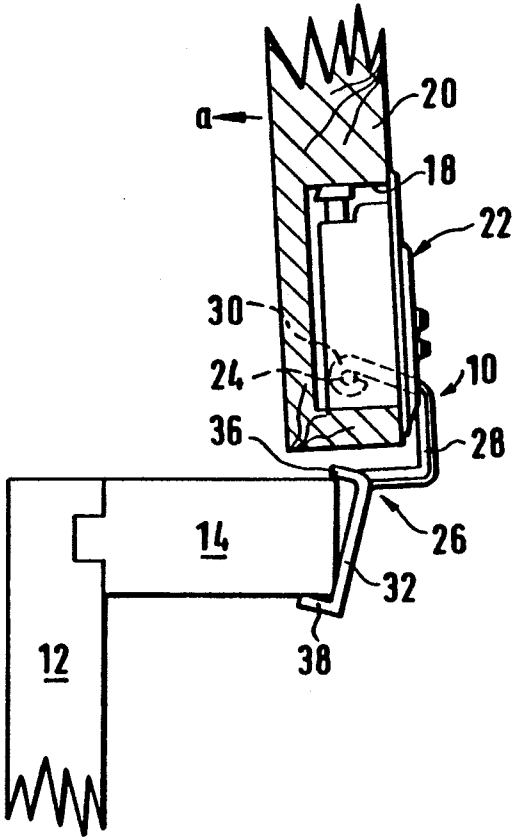
Figure 3A:
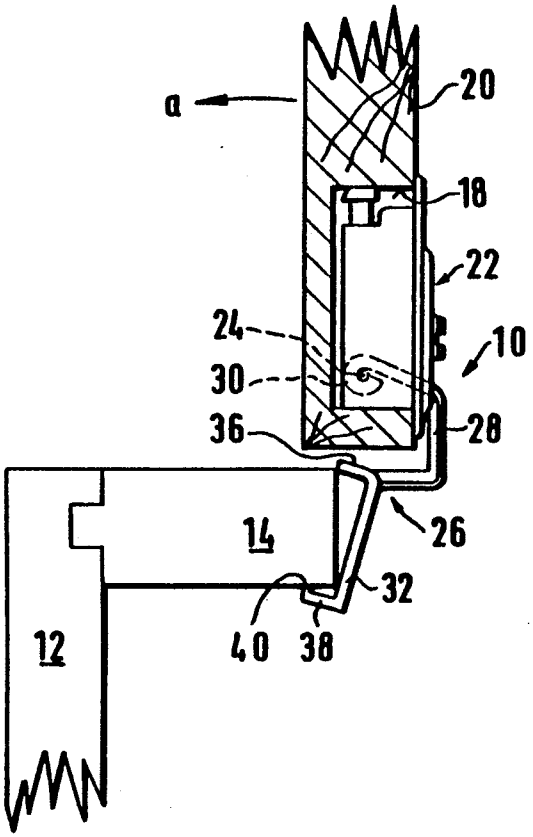

FIGS. 3*a* to 3*c* illustrate the manner in which a door provided with pre-installed hinges 10 can be hung on a cabinet by one person. Let it be assumed that the cabinet is lying on its back, and the doors together with the hinge arm 30 of the hinge set to the open position are carried, hanging from a lift, to the upturned, open front of the cabinet. The hinge arm 30 is then guided over the stile 14 such that the inside tabs 38 are lying with the projections 40 against the inside surface of the stiles 14, in the tilted position shown in FIG. 3*a*, while the inner arris of the surface 16 of the stiles makes contact with the inside of the mounting plate 32, and the free ends of the tabs bent down from the front edge of the mounting plate contact the front arris of the surface 16. If now the installer exerts a force on the door in the direction of the arrows a in FIGS. 3*a* and 3*b*, the tabs 36 will pass over the associated front edge of the stile, while the tabs 38, and possibly also tabs 36, are positively forced apart resiliently. The force exerted by the projections 40 on the stile 14 causes projections 40 to penetrate into the back of the stile. This assures that, when the door reaches the correct mounting position, which is shown in FIG. 3*c*, it is temporarily installed, even if the screw 37 has not yet been driven in. After the precise alignment of the door relative to the carcase has been completed, the mounting screw can be driven in without the need for the door to be held in the selected position by a second person.

It can be seen that, within the scope of the invention, modifications and further developments of the embodiment shown can be made within the scope of the appended claims.

I claim:

1. A cabinet hinge for hanging a door on a frame member of a carcase of a cabinet, said cabinet having a frame on its front surface, said frame narrowing an opening of the front surface of said cabinet, said frame being formed by frame members reaching inwardly from walls of said cabinet, which is at least partially covered by an inside surface of the door in a closed position, said hinge comprising:

a hinge arm of sheet metal, said hinge arm including a mounting plate at one end of said hinge arm for placement onto a free edge of a frame member of a frame, said free edge facing away from a side wall, and releasably fastened onto said free edge, said mounting plate having a width corresponding to the width of an edge of the frame member said hinge arm coupled by a joint mechanism to a part of the hinge attached to the door, said mounting plate having front and back surfaces onto which is provided at least one tab bent substantially at right angles with respect to said surfaces and onto an exterior flat side of the frame member, and at least one tab bent substantially at right angles with respect to said surfaces and onto an interior flat side of the frame member and having a sharpened or knife-edge like projection extending in a direction toward the first mentioned at least one tab and toward the interior flat side of the frame member so that said door at least partially overlaps the front surface of said frame member in a closed position.

2. The hinge according to claim 1, wherein, the bent tabs are provided on outer and inner edge surfaces of the mounting plate, at least the tabs on one of the outer and inner surfaces are disposed resiliently deformably on the mounting plate, so that the distance existing between the tabs on the inner and outer edge surfaces is variable in a given range without permanent deformation.

3. The hinge according to claim 2, wherein the tabs are made springy.

4. The hinge according to claim 2, wherein the tabs are formed on a portion of the mounting plate of the hinge arm, which in turn is joined in a resiliently deformable manner to the remaining part of the mounting plate.

5. The hinge according to claim 3, wherein the tabs are formed on a portion of the mounting plate of the hinge arm, which in turn is joined in a resiliently deformable manner to the remaining part of the mounting plate.

6. The hinge according to claim 1, wherein the projection provided on said at least one tab of the hinge arm which is placed onto an interior flat surface of the frame member is provided in each case on a free margin of the tab facing away from the mounting plate and is sharpened and has an approximately circular segment-shaped profile.

7. The hinge according to claim 1, wherein an elongated fastening opening is provided in the mounting plate and extending in a lengthwise direction of the mounting plate of the hinge arm so that a mounting screw can be driven with its shaft into the frame member.

8. The hinge according to claim 1, wherein the bent tabs are provided on an outside edge of the mounting plate and having a rounded cross section in the area of their free end on the side of the tabs facing the outer flat side of the associated frame member.

* * * * *